US008517838B2

(12) United States Patent
Wu

(10) Patent No.: US 8,517,838 B2
(45) Date of Patent: Aug. 27, 2013

(54) ONLINE GAME SYSTEM AND METHOD OF DATA RESOURCE HANDLING FOR AN ONLINE GAME

(75) Inventor: Hao Wu, Beijing (CN)

(73) Assignee: Xpec Entertainment Inc., Taipei (TW)

( * ) Notice: Subject to any disclaimer, the term of this patent is extended or adjusted under 35 U.S.C. 154(b) by 3 days.

(21) Appl. No.: 13/238,918

(22) Filed: Sep. 21, 2011

(65) Prior Publication Data

US 2012/0083343 A1 Apr. 5, 2012

(30) Foreign Application Priority Data

Oct. 1, 2010 (TW) ..... 99133524 A

(51) Int. Cl.
*G07F 17/32* (2006.01)

(52) U.S. Cl.
USPC ..... 463/42; 463/40; 463/43

(58) Field of Classification Search
USPC ..... 463/40–42, 43
See application file for complete search history.

(56) References Cited

U.S. PATENT DOCUMENTS

| | | | | |
|---|---|---|---|---|
| 8,064,478 | B2 * | 11/2011 | Morrow et al. | 370/466 |
| 2001/0044339 | A1 * | 11/2001 | Cordero et al. | 463/42 |
| 2006/0287099 | A1 * | 12/2006 | Shaw et al. | 463/42 |

* cited by examiner

*Primary Examiner* — Omkar Deodhar
(74) *Attorney, Agent, or Firm* — Pillsbury Winthrop Shaw Pittman, LLP

(57) ABSTRACT

An online game system is capable of connection with a client through a communication network to provide an online game to the client. The online game system includes a gaming logic server cluster and a network resource server cluster. The gaming logic server cluster is configured for providing at least one of client login service, client account service, game logic operation service, game database service and data backup service related to the online game. The network resource server cluster is configured for providing data resources associated with gaming images of the online game to the client.

10 Claims, 7 Drawing Sheets

ONLINE GAME SYSTEM AND METHOD OF DATA RESOURCE HANDLING FOR AN ONLINE GAME

CROSS-REFERENCE TO RELATED APPLICATION

This application claims priority of Taiwanese Application No. 099133524, filed on Oct. 1, 2010.

BACKGROUND OF THE INVENTION

1. Field of the Invention

The present invention relates to an online game system and a method of data resource handling for an online game, more particularly to an online game system including a gaming logic server cluster and a network resource server cluster, and to a method of data resource handling for an online game involving the gaming logic server cluster and the network resource server cluster.

2. Description of the Related Art

The World Wide Web (abbreviated as Web, WWW, or W3) is a system of interlinked hypertext documents accessed through the Internet. Various kinds of useful information in the system of the World Wide Web are known as resources, and users can browse and access the resources through the Hypertext Transfer Protocol (HTTP).

Nowadays, online games or web games (e.g., a massive multiplayer online role-playing game, MMORPG) are more and more popular and are gradually developed to have relatively finer gaming images. A conventional online game server of the MMORPG is configured to handle a virtual world of the MMORPG, and a player can play a virtual character in the virtual world of the MMORPG using a client computer installed with a game program associated with the MMORPG. The conventional online game server stores the data of a plurality of the virtual characters associated with respective players of the MMORPG. In this way, those players at various locations around the physical world can have real-time interaction with each other when they play the respective virtual characters using respective client computers to connect to and login the conventional online game server through the Internet.

However, as the online/web games have the relatively finer gaming images, data transmission of various data resources (such as the data resources related to scenes, animation, video effects, etc.) between the client computers and the conventional online game server is significantly increased. Therefore, the load of the online game server is critically heavy, and the client computers may not immediately display the gaming images in real time if there is no sufficient bandwidth of a communication network between the client computers and the online game server.

SUMMARY OF THE INVENTION

Therefore, an object of the present invention is to provide an online game system that can alleviate the above drawbacks of the prior art.

Accordingly, an online game system of this invention is capable of connection with a client through a communication network to provide an online game to the client. The online game system comprises a gaming logic server cluster and a network resource server cluster.

The gaming logic server cluster is configured for providing at least one of client login service, client account service, game logic operation service, game database service and data backup service related to the online game. The network resource server cluster is configured for providing data resources associated with gaming images of the online game to the client.

Another object of the present invention is to provide a method of data resource handling for an online game.

According to another aspect, a method of data resource handling for an online game of this invention comprises the steps of:

a) providing a gaming logic server cluster configured to provide at least one of client login service, client account service, game logic operation service, game database service and data backup service related to the online game; and b) providing a network resource server cluster configured to provide data resources associated with gaming images of the online game to a client.

According to yet another aspect, a method of data resource handling for an online game of this invention is to be implemented using an online game system that includes a plurality of data servers. The method comprises:

i) configuring the online game system for classifying a plurality of sets of data resources of the online game according to types of the data resources;

ii) configuring the online game system for generating a plurality of files corresponding to respective sets of the data resources of the online game, each of the files having a content data block that includes a plurality of content data sets of a corresponding one of the sets of the data resources and a file header that describes a number of the content data sets, and a size and a name length of each of the content data sets;

iii) configuring the online game system for storing the files in respective ones of the data servers according to the classification made in step i); and iv) configuring the online game system for receiving a resource request from a client and for providing the data resources stored in one of the data servers according to a corresponding one of the files that is associated with the resource request received from the client.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
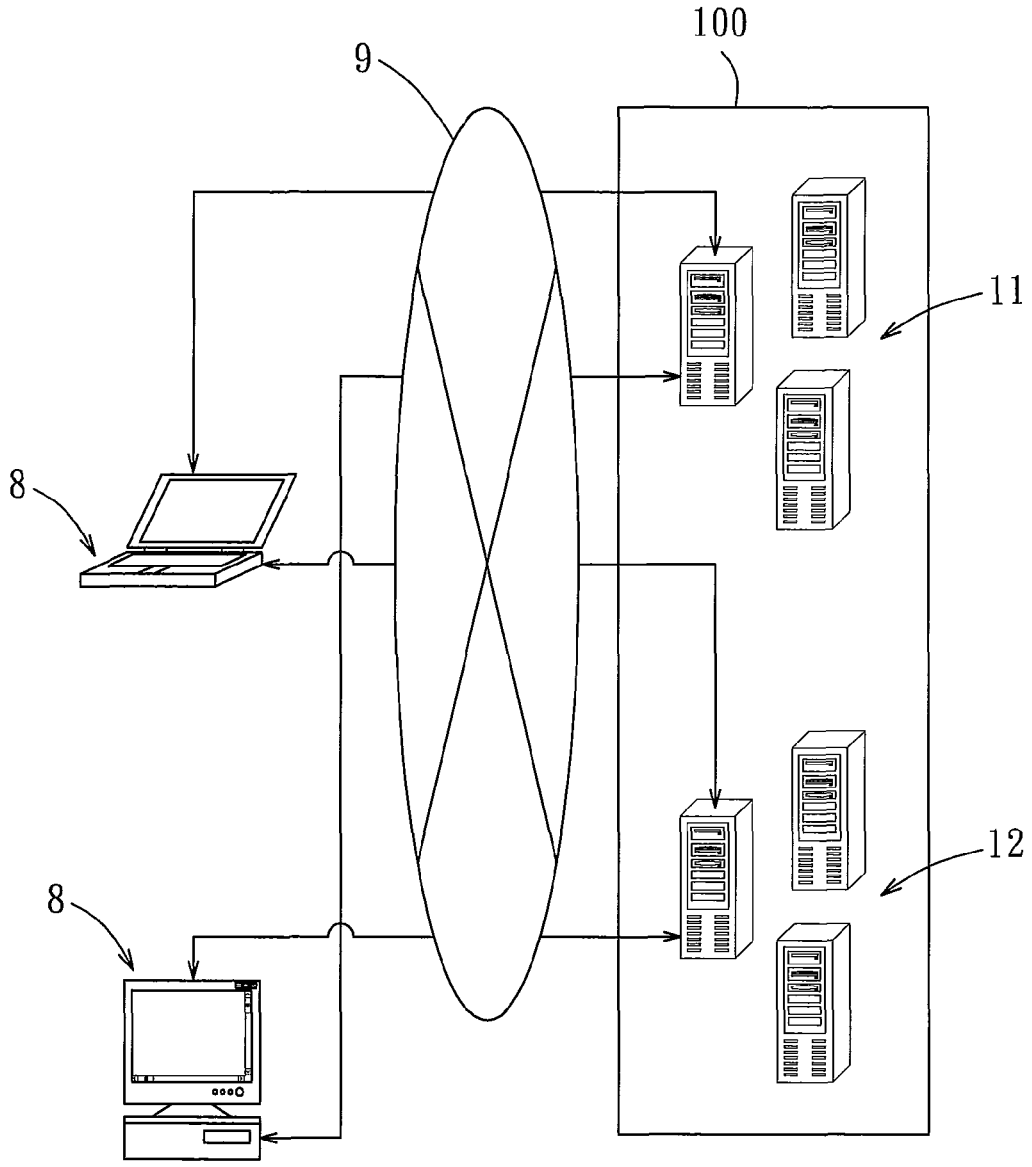
FIG. 1 is a schematic diagram illustrating a preferred embodiment of an online game system of the present invention that is connected to a plurality of clients.

Referring to FIG. 1, a preferred embodiment of an online game system 100 according to this invention includes a gaming logic server cluster 11 and a network resource server cluster 12. The online game system 100 is capable of connection with a plurality of clients 8 through a communication network 9 to provide an online game or a web game that has a virtual world with a plurality of virtual zones to the clients 8, such a massive multiplayer online role-playing game (abbreviated as MMORPG). In practice, the communication network 9 may be a wired network, or a wireless network such as the general packet radio service (GPRS), the $3^{RD}$ generation mobile telecommunication (3G), and the worldwide interoperability for microwave access (WiMAX).

In this embodiment, connection between the gaming logic server cluster 11 and the clients 8 is a full-duplex connection based upon a transmission control protocol (TCP) socket for communication related to logic operation of the online/web game. On the other hand, connection between the network resource server cluster 12 and the clients 8 is based on the hyper text transfer protocol (HTTP) for data transmission through the HTTP. In particular, the network resource server cluster 12 is configured to transmit data resources to the clients 8 in response to requests from the clients 8. It should be noted that the gaming logic server cluster 11 is not directly connected to the network resource server cluster 12, and the clients 8 connected to the gaming logic server cluster 11 can download the data resources from the network resource server cluster 12 so that the load of the online game system 100 can be shared.

Figure 2:
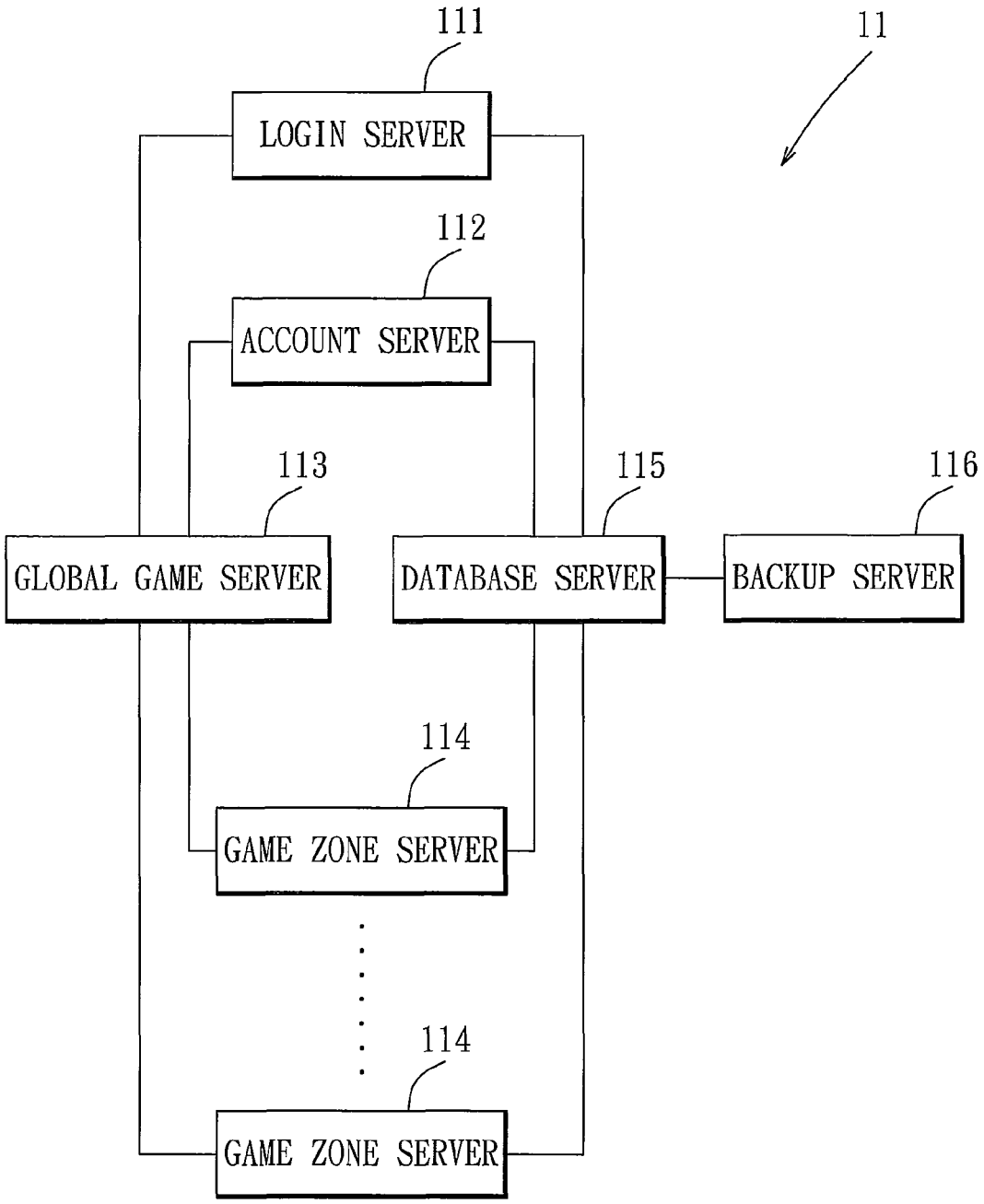
FIG. 2 is a block diagram illustrating a gaming logic server cluster of the online game system of the preferred embodiment.

Referring to FIG. 2, the gaming logic server cluster 11 is configured to provide client login service, client account service, game logic operation service, game database service and data backup service related to the online/web game. In this embodiment, the gaming logic server cluster 11 includes a login server 111, an account server 112, a global game server 113, a plurality of game zone servers 114, a database server 115, and a backup server 116. Each of the game zone servers 114 is associated with a respective one of the virtual zones of the virtual world of the online/web game, and with a respective Internet protocol (IP) address. The database server 115 and the backup server 116 are configured to provide the game database service (e.g., storage of account information of players of the online/web game) and the data backup service, respectively.

The login server 111 and the account server 112 are configured for a short-term connection with the client 8. In particular, the login server 111 is operable to actively disable the connection with the client 8 after verification of identity of the client 8 is successful. Then, the account server 112 is operable to allow the client 8 to manage characters of an account associated therewith, and is configured to be connected to the client 8 until the player associated with the client 8 inputs a start command to play the online/web game. The management of the characters of the account includes, for example, creation of a new character, deletion of an existing character, etc.

Different from the short-term connection, the global game server 113 and the game zone servers 114 are configured for a long-term connection with the client 8. The global game server 113 is configured for the logic operation related to the entire virtual world of the online/web game, for example, chatting among the players around the virtual world and data synchronization of the account information of the players. After a player associated with the client 8 inputs the start command to play the online/web game, the global game server 113 is connected to the client 8 until the player inputs a logout command to finish the online/web game or directly closes a browser that is running the online/web game. During the online/web game, the client 8 is only connected to one of the game zone servers 114 that is associated with one of the virtual zones where a virtual character of the account of the player associated with the client 8 is currently located. When the virtual character moves to another one of the virtual zones, the client 8 is disconnected from said one of the game zone servers 114 and is connected to another one of the game zone servers 114 that is associated with said another one of the virtual zones.

Regarding hardware construction of the gaming logic server cluster 11, the global game server 113 and the game zone servers 114 are not built in the same physical server, and the database server 115 and the backup server 116 are separately built as respective physical servers. For the logic operation, the login server 111, the account server 112, the global game server 113 and the game zone servers 114 are connected with each other and are further connected to the database server 115.

Figure 3:
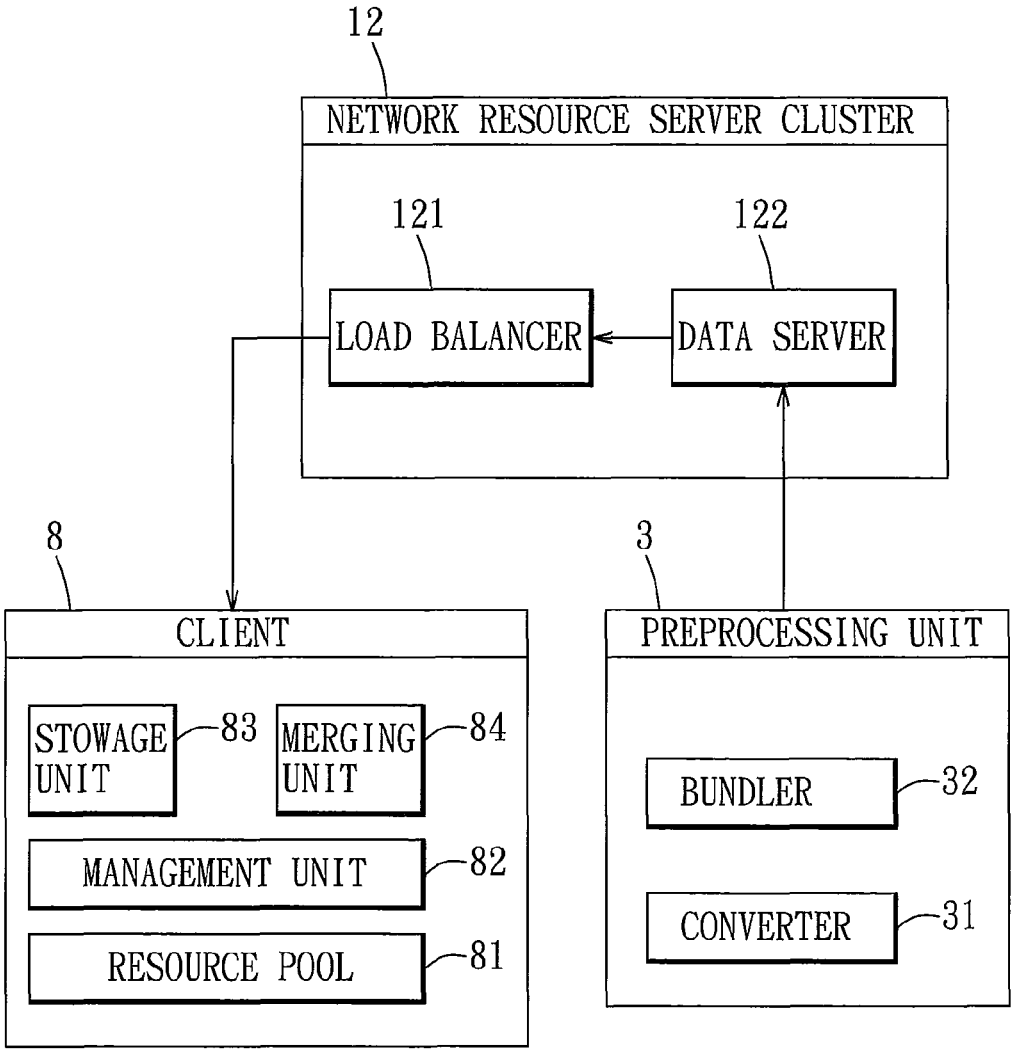
FIG. 3 is a block diagram illustrating relationships among a network resource server cluster and a preprocessing unit of the online game system and a client connected to the online game system.

Referring to FIG. 3, the network resource server cluster 12 is configured to provide various data resources related to the gaming images (such as the data resources related to scenes, animation, video effects, etc.) to the client 8 connected thereto. The network resource server cluster 12 includes a load balancer 121, and a plurality of data servers 122 (only one is shown in FIG. 3 for convenience of illustration) connected to the load balancer 121 and to a preprocessing unit 3. In this embodiment, the data servers 122 are Apache Web servers supporting the HTTP service. The connection between the network resource server cluster 12 and the client 8 is a short-term connection, and the network resource server cluster 12 will not store any information of the client 8.

The data servers 122 of the network resource server cluster 12 store respective files (see FIG. 6) corresponding respective sets of the data resources. Each of the files has a content data block 62 that includes a plurality of content data sets of a corresponding one of the sets of the data resources, and a file header 61 that describes a number of the content data sets, and a size and a name length of each of the content data sets. The load balancer 121 of the network resource server cluster 12 is configured to receive a resource request from the client 8, and is operable to provide one of the sets of the data resources according to a corresponding one of the files that is associated with the resource request received from the client 8.

Figure 4A:
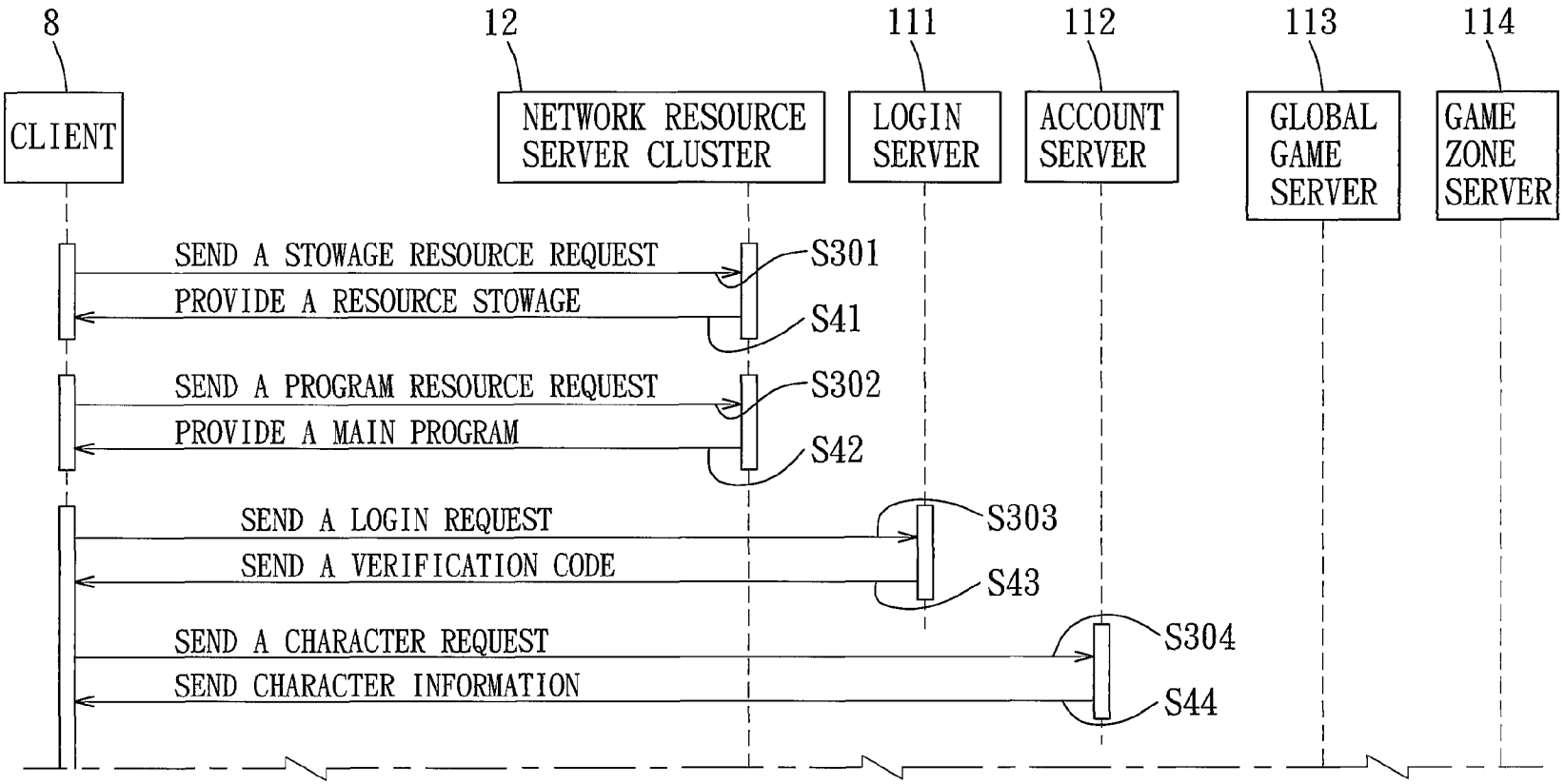
FIGS. 4A and 4B are a flow chart illustrating a method of data resource handling for an online game that is to be implemented using the online game system of the preferred embodiment.
Figure 4B:
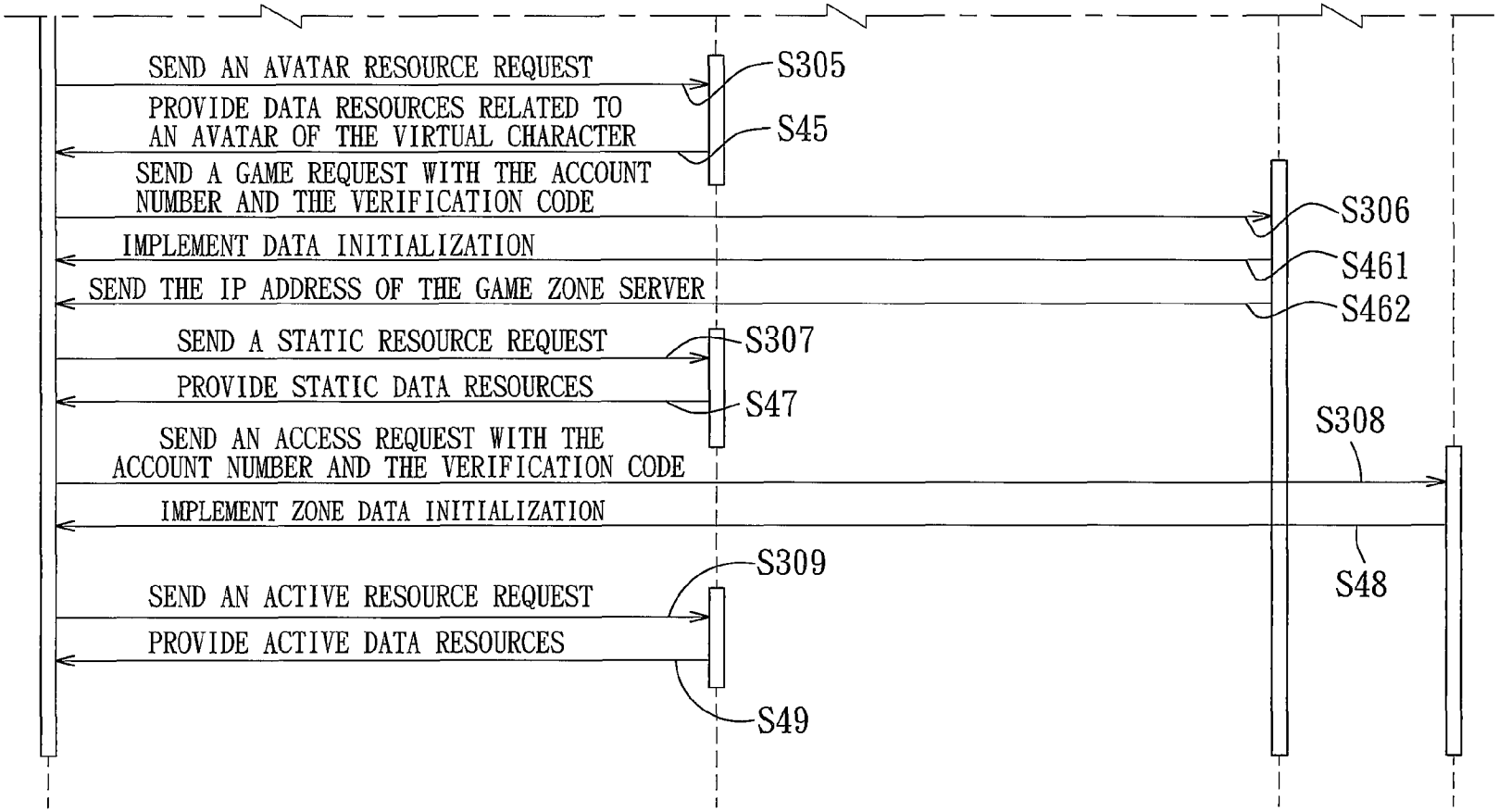

Referring to FIGS. 4A and 4B, the online game system 100 is configured to implement a method of data resource handling for the online/web game. The method includes the following steps.

In step S301, the client 8 is operable to send a stowage resource request to the network resource server cluster 12. Then, in step S41, the network resource server cluster 12 is operable to provide a resource stowage to the client 8 in response to the stowage resource request. The resource stowage is used for obtaining from designated positions the data resources to be used by a main program of the online/web game.

In step S302, the client 8 is operable to send a program resource request to the network resource server cluster 12. Then, in step S42, the network resource server cluster 12 is operable to provide the main program to the client 8 in response to the program resource request. The main program is a portal program of the online/web game, and bundles a set of data resources and is downloaded by the client 8 with the resource stowage obtained in step S41.

In step S303, the client 8 is operable to send a login request with an account number and a password to the login server 111. In response to the login request from the client 8, the login server 111 is operable, in step S43, to verify identity of the client 8 in response to the login request and to send a verification code to the client when verification of the identity of the client 8 is successful. The verification code enables the client 8 to issue a character request.

In step S304, the client 8 is configured to send the character request to the account server 112. Then, in response to the character request from the client 8, the account server 112 is operable, in step S44, to send character information of a virtual character associated with the client 8 (i.e., associated with the account number provided by the client 8 in step S303). The character information includes, for example, unique identification, name, level, character profession, sex and equipments of the virtual character, and a payment state of the account associated with the virtual character. The character information enables the client 8 to issue a game request.

In step S305, the client 8 is configured to send an avatar resource request to the network resource server cluster 12. In response to the avatar resource request from the client 8, the network resource server cluster 12 is operable to provide the data resources related to an avatar of the virtual character to the client 8 in step S45.

In step S306, the client 8 is configured to send the game request with the account number and the verification code received in step S43 to the global game server 113 for accessing the global game server 113. In response to the game request from the client 8, the global game server 113 is operable to implement data initialization in step S461, and to send the IP address of one of the game zone servers 114 associated with the respective virtual zone where the virtual character associated with the client 8 is currently located in step S462. In particular, the global game server 113 is operable to read detailed information of the virtual character (e.g., a friend list, a guild to which the virtual character belongs, etc.), and to dispose the virtual character into the virtual world of the online/web game. Thus, after the client 8 accesses the global game server 113, the player associated with the client 8 can communicate with other players through the virtual character, and the global game server 113 is operable to determine which one of the virtual zones in the virtual world where the virtual character is currently located and to send the IP address of a corresponding one of the game zone servers 114 that is associated with said one of the virtual zones to the client 8.

Then, the client 8 is configured to send a static resource request to the network resource server cluster 12 in step S307, and the network resource server cluster 12 is operable, in response to the static resource request, to provide static data resources to the client 8 in step S47. In should be noted that the static data resources are necessary for starting the online/web game, and include, for example, visual data resources related to the gaming images (such as information and picture resources for displaying the virtual zone where the virtual character is currently located) and static information of the online/web game (such as information of various equipments, items, character profession, skills, etc.).

In step S308, the client 8 is configured to send an access request with the account number and the verification code received in step S43 to the corresponding one of the game zone servers 114 that is associated with the IP address received in step S462. Then, in response to the access request, the corresponding one of the game zone servers 114 is operable to allow connection with the client 8 and to implement zone data initialization in step S48. In the zone data initialization, the corresponding one of the game zone servers 114 is operable to handle and process the data including the virtual zone where the virtual character is currently located, a position of the virtual character in the virtual zone and other virtual characters nearby, and to send a notification to these nearby virtual characters.

The client 8 is configured to send an active resource request to the network resource server cluster 12 in step S309, and the network resource server cluster 12 is operable, in response to the active resource request, to provide active data resources to the client 8 in step S49. Compared with the static data resources, the active data resources are not involved with the logic operation and are actively and frequently used in the online/web game. Therefore, it is not required to load the active data resources before the online/web game starts. The active data resources include, for example, a module of appearance of the virtual character, appearance of non-player characters and monsters, etc.

Figure 5:
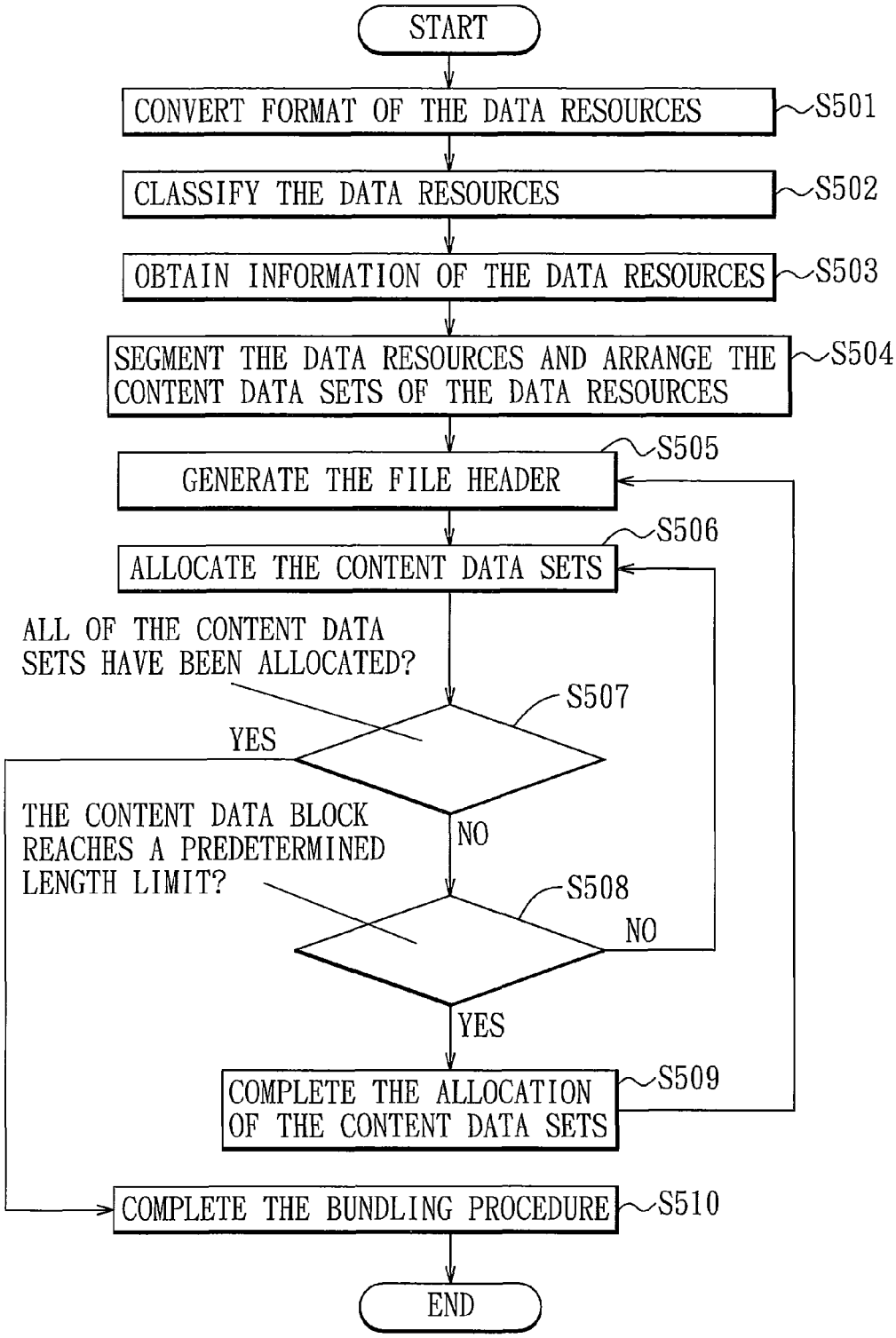
FIG. 5 is a flow chart illustrating a procedure for generating files corresponding to respective sets of data resources of an online game.
Figure 6:
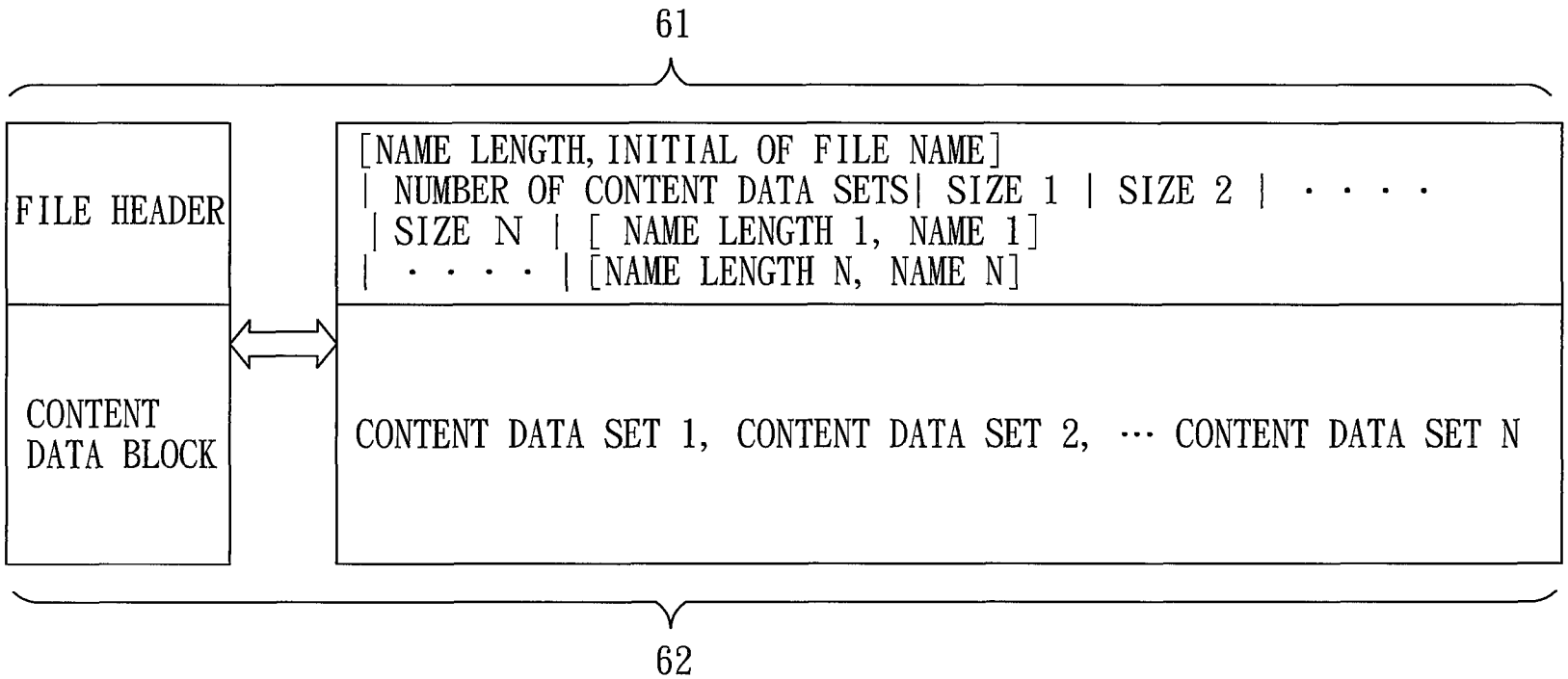
FIG. 6 illustrates an example of a file having a content data block and a file header that is generated by the preprocessing unit of FIG. 3.

Referring to FIGS. 3, 5 and 6, the preprocessing unit 3 connected to the network resource server cluster 12 includes a converter 31 and a bundler 32. As described above, the data servers 122 of the network resource server cluster 12 store the plural files corresponding to the respective sets of the data resources, and each of these files is generated using the preprocessing unit 3 to implement a bundling procedure with the following steps.

The converter 31 is operable, in step S501, to convert format of the data resources of the online/web game (e.g., the XML format) into a self-defined format that is accessible to the main program and that is easier to be used and occupies less resource in the online/web game. In step S502, the bundler 32 is operable to classify the sets of the data resources according to types of the data resources, such as the static data resources and the active data resources. In step S503, the bundler 32 is operable to make statistics and to obtain information of the data resources. In step S504, the bundler 32 is operable to segment the data resources according to a predetermined file length, and to arrange the content data sets of the data resources in a specific order.

Then, for each set of the data resources, the bundler 32 is operable to generate the file header 61 of the file corresponding to the set of the data resources in step S505, and to allocate the content data sets into the content data block 62 of the file according to the specific order in step S506. In step S507, the bundler 32 is operable to determine whether all of the content data sets of the set of the data resources have been allocated into the file. The bundler 32 is operable to further determine whether the content data block reaches a predetermined length limit in step S508 when there are still some of the content data sets that have not yet been allocated into the file, and to implement step S510 to store the file to a corresponding one of the data servers 122 so as to complete the bundling procedure when otherwise. When it is determined that the predetermined length limit is reached in step S508, the bundler 32 is operable to complete the allocation of the content data sets in step S509 and the flow goes back to step S505. When it is determined that the predetermined length limit has not yet been reached in step S508, the flow goes back to step S506.

As shown in FIG. 3, the client 8 includes a resource pool 81, a management unit 82, a stowage unit 83, and a merging unit 84.

The resource pool 81 is configured to store the data resources received from the network resource server cluster 12, and to pack related data resources. For example, the visual data resources related to the gaming images are packed and compressed into a SWF file. The resource pool 81 is further configured to manage service lives of the data resources. Namely, how long the data resources are used, and when and how the data resources are deleted are managed by the resource pool 81 according to a preset rule.

The management unit 82 is configured to integrate access of the data resources, and to automatically monitor the data resources for releasing the data resources that are not used anymore from memory of the client 8 according to a predefined strategy. In this way, utilization of the data resources and efficiency of the memory of the client 8 are balanced. Further, the management unit 82 is operable to dispatch various functional modules of the client 8 (i.e., the resource pool 81, the stowage unit 83, the merging unit 84, etc.), and to create the functional modules using an object-oriented design pattern (e.g., the factory method pattern).

Before starting the online/web game, the stowage unit 83 is operable to read parts of the data resources that are frequently used and to arrange these data resources in various batches. Thus, the client 8 may smoothly execute the online/web game by reading relatively less data resources, and display relatively smoother and finer gaming images to the player.

The merging unit 84 is configured to merge the data resources stored in the resource pool 81, and to unpack and decompress the data resources so as to obtain a completed set of the data resources. In this way, it is ensured that the stowage unit 83 can obtain the completed set of the data resources from the resource pool 81 through the merging unit 84.

In summary, the online game system 100 according to this invention includes the gaming logic server cluster 11 and the network resource server cluster 12 so that the load of the online game system 100 can be shared. Further, the data servers 122 of the network resource server cluster 12 store the respective files, and the content data sets of the data resources are segmented and are arranged in the specific order. Thus, it is relatively easier and faster to provide the data resources to the client 8 according to a corresponding one of the files that is associated with the resource request received from the client 8.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An online game system capable of connection with a client through a communication network to provide an online game to the client, said online game system comprising:

a gaming logic server cluster for providing at least one of client login service, client account service, game logic operation service, game database service and data backup service related to the online game; and a network resource server cluster for providing data resources associated with gaming images of the online game to the client, wherein said network resource server cluster stores a plurality of files corresponding respectively to sets of the data resources, each of the files having a content data block that includes a plurality of content data sets of a corresponding one of the sets of the data resources and a file header that describes a number of the content data sets, and a size and a name length of each of the content data sets, said network resource server cluster being configured to receive a resource request from the client and being operable to provide one of the sets of the data resources according to a corresponding one of the files that is associated with the resource request received from the client.

2. The online game system as claimed in claim 1, wherein said gaming logic server cluster includes:

a login server configured to receive a login request from the client and operable to verify identity of the client in response to the login request and to send a verification code to the client when verification of the identity of the client is successful, the verification code enabling the client to issue a character request;

an account server configured to receive the character request from the client and operable to send character information of a virtual character associated with the client in response to the character request, the character information enabling the client to issue a game request;

a plurality of game zone servers each associated with a respective virtual zone of the online game and with a respective Internet protocol address; and a global game server configured to receive the game request from the client and operable to send the Internet protocol address of one of said game zone servers associated with the respective virtual zone where the virtual character associated with the client is currently located, wherein said one of said game zone servers associated with the respective virtual zone where the virtual character associated with the client is currently located is operable to provide game progress services to the client upon connection with the client.

3. The online game system as claimed in claim 1, wherein connection between said gaming logic server cluster and the client is a full-duplex connection based upon a transmission control protocol socket.

4. The online game system as claimed in claim 1, wherein connection between said network resource server cluster and the client is based on the hyper text transfer protocol.

5. The online game system as claimed in claim 1, wherein the data resources provided by said network resource server cluster are selected from static data resources and active data resources.

6. A method of data resource handling for an online game, comprising:

a) providing a gaming logic server cluster configured to provide at least one of client login service, client account service, game logic operation service, game database service and data backup service related to the online game; and b) providing a network resource server cluster configured to provide data resources associated with gaming images of the online game to a client, wherein the network resource server cluster stores a plurality of files corresponding respectively to sets of the data resources, each of the files having a content data block that includes a plurality of content data sets of a corresponding one of the sets of the data resources and a file header that describes a number of the content data sets, and a size and a name length of each of the content data sets, the network resource server cluster being configured to receive a resource request from the client and being operable to provide one of the sets of the data resources according to a corresponding one of the files that is associated with the resource request received from the client.

7. The method as claimed in claim 6, wherein the gaming logic server cluster includes:

a login server configured to receive a login request from the client and operable to verify identity of the client in response to the login request and to send a verification code to the client when verification of the identity of the client is successful, the verification code enabling the client to issue a character request;

an account server configured to receive the character request from the client and operable to send character information of a virtual character associated with the client in response to the character request, the character information enabling the client to issue a game request;

a plurality of game zone servers each associated with a respective virtual zone of the online game and with a respective Internet protocol address; and a global game server configured to receive the game request from the client and operable to send the Internet protocol address of one of the game zone servers associated with the respective virtual zone where the virtual character associated with the client is currently located, wherein said one of the game zone servers associated with the respective virtual zone where the virtual character associated with the client is currently located is operable to provide game progress services to the client upon connection with the client.

8. The method as claimed in claim 6, wherein the data resources provided by the network resource server cluster are selected from static data resources and active data resources.

9. A method of data resource handling for an online game, said method to be implemented using an online game system that includes a plurality of data servers and comprising:

i) configuring the online game system for classifying a plurality of sets of data resources of the online game according to types of the data resources;

ii) configuring the online game system for generating a plurality of files corresponding to respective sets of the data resources of the online game, each of the files having a content data block that includes a plurality of content data sets of a corresponding one of the sets of the data resources and a file header that describes a number of the content data sets, and a size and a name length of each of the content data sets;

iii) configuring the online game system for storing the files in respective ones of the data servers according to the classification made in step i); and iv) configuring the online game system for receiving a resource request from a client and for providing the data resources stored in one of the data servers according to a corresponding one of the files that is associated with the resource request received from the client.

10. The method as claimed in claim 9, wherein, in step i), the data resources are classified into static data resources and active data resources.

* * * * *